US009873924B2

(12) United States Patent
Santacreu et al.

(10) Patent No.: US 9,873,924 B2
(45) Date of Patent: Jan. 23, 2018

(54) FERRITIC STAINLESS STEEL SHEET, METHOD FOR THE PRODUCTION THEREOF, AND USE OF THE SAME, ESPECIALLY IN EXHAUST LINES

(75) Inventors: Pierre-Olivier Santacreu, Isbergues (FR); Claudine Miraval, Bethune (FR); Saghi Saedlou, Lille (FR)

(73) Assignee: APERAM STAINLESS FRANCE, Saint Denis (FR)

( * ) Notice: Subject to any disclaimer, the term of this patent is extended or adjusted under 35 U.S.C. 154(b) by 239 days.

(21) Appl. No.: 14/425,313

(22) PCT Filed: Sep. 3, 2012

(86) PCT No.: PCT/FR2012/051969

§ 371 (c)(1),
(2), (4) Date: Dec. 7, 2015

(87) PCT Pub. No.: WO2014/033372

PCT Pub. Date: Mar. 6, 2014

(65) Prior Publication Data

US 2016/0115562 A1 Apr. 28, 2016

(51) Int. Cl.
*C21D 8/02* (2006.01)
*C21D 9/46* (2006.01)
(Continued)

(52) U.S. Cl.
CPC ..... *C21D 8/0205* (2013.01); *B22D 7/00* (2013.01); *C21D 6/002* (2013.01); *C21D 6/004* (2013.01);
(Continued)

(58) Field of Classification Search
None
See application file for complete search history.

(56) References Cited

U.S. PATENT DOCUMENTS 9,487,849 B2 * 11/2016 Ishii ..... C21D 9/46
2004/0265162 A1 * 12/2004 Songini ..... C21D 6/002 420/62

FOREIGN PATENT DOCUMENTS

JP H05-70899 A 3/1993
JP H06-279951 A 10/1994
(Continued)

OTHER PUBLICATIONS

Machine-English translation of JP 2003-138347, Yazawa Yoshihiro et al., May 14, 2003.*

*Primary Examiner* — Deborah Yee
(74) *Attorney, Agent, or Firm* — Knobbe Martens Olson & Bear LLP

(57) ABSTRACT

A ferritic stainless steel sheet of a composition, expressed in weight percentages: trace amounts≤C≤0.03%; 0.2%≤Mn≤1%; 0.2%≤Si≤1%; trace amounts≤S≤0.01%; trace amounts≤P≤0.04%; 15%≤Cr≤22%; trace amounts≤Ni≤0.5%; trace amounts≤Mo≤2%; trace amounts≤Cu≤0.5%; 0.160%≤Ti≤1%; 0.02%≤Al≤1%; 0.2%≤Nb≤1%; trace amounts≤V≤0.2%; 0.009%≤N≤0.03%; trace amounts≤Co≤0.2%; trace amounts≤Sn≤0.05%; rare earths (REE)≤0.1%; trace amounts≤Zr≤0.01%; the remainder of the composition consisting of iron and of inevitable impurities resulting from the elaboration; the Al and rare earth (REE) contents satisfying the relationship: Al+30×REE≥0.15%; the Nb, C, N and Ti contents in % satisfy the relationship: 1/[Nb+(7/4)×Ti−7×(C+N)]≤3; said metal sheet having an entirely recrystallized structure and an average ferritic grain size comprised between 25 and 65 μm.
A method for manufacturing such a ferritic stainless steel sheet, and its use for manufacturing parts involving shaping and welding and intended to be subject to a periodic tem-
(Continued)

perature of use comprised between 150° C. and 700° C. and to a projection of a mixture of water, urea and ammonia.

10 Claims, 2 Drawing Sheets

(51) Int. Cl.

| | |
|---|---|
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***B22D 7/00*** | (2006.01) |
| ***F01N 3/20*** | (2006.01) |

(52) U.S. Cl.
CPC ..... *C21D 6/005* (2013.01); *C21D 6/007* (2013.01); *C21D 6/008* (2013.01); *C21D 8/0226* (2013.01); *C21D 8/0236* (2013.01); *C21D 8/0263* (2013.01); *C21D 8/0273* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *F01N 3/2066* (2013.01); *C21D 2211/005* (2013.01); *F01N 2610/02* (2013.01)

(56) References Cited

FOREIGN PATENT DOCUMENTS

| | | | |
|---|---|---|---|
| JP | 2007-009290 | A | 1/2007 |
| JP | 2007-302995 | A | 11/2007 |
| JP | 2011-105976 | A | 6/2011 |
| WO | 2012/133681 | A1 | 10/2012 |

* cited by examiner

FERRITIC STAINLESS STEEL SHEET, METHOD FOR THE PRODUCTION THEREOF, AND USE OF THE SAME, ESPECIALLY IN EXHAUST LINES

CROSS-REFERENCE TO RELATED APPLICATIONS

This application is the U.S. National Phase under 35. U.S.C. §371 of International Application PCT/FR2012/051969, filed Sep. 3, 2012. The disclosures of the above-described application are hereby incorporated by reference in their entirety.

The invention relates to a ferritic stainless steel, to its manufacturing method, and to its use for manufacturing mechanically welded parts subject to high temperatures, such as elements of exhaust lines of internal combustion engines.

For certain applications of ferritic stainless steels, such as parts located in the hot portions of exhaust lines of internal combustion engines equipped with a pollution control system with urea or ammonia (private vehicles, trucks, construction machinery, agricultural machines, or sea transport machines) ensuring reduction of nitrogen oxides, are simultaneously sought:

- good resistance to oxidation;
- good mechanical resistance at high temperature, i.e. preservation of high mechanical characteristics and of good resistance to creep and thermal fatigue;
- and good resistance to corrosion by urea, ammonia, their decomposition products.

Indeed, these parts are subject to temperatures comprised between 150 and 700° C., and to a projection of a urea and water mixture (typically 32.5% of urea—67.5% of water), or of a mixture of ammonia and water, or of pure ammonia. The decomposition products of urea and ammonia may also degrade the parts of the exhaust line.

Mechanical resistance at high temperature should also be adapted to thermal cycles associated with acceleration and deceleration phases of the engines. Further, the metal should have good cold formability so as to be shaped by bending or by hydroforming, as well as good weldability.

Different grades of ferritic stainless steels are available for meeting the specific requirements of various areas of the exhaust line.

Thus ferritic stainless steels are known with 17% Cr stabilized with 0.14% of titanium and 0.5% of niobium (type EN 1.4509, AISI 441) allowing use up to 950° C.

Ferritic stainless steels with a lower chromium content are also known, for example steels with 12% of Cr stabilized with 0.2% of titanium (type EN 1.4512 AISI 409) for maximum temperatures below 850° C., steels with 14% of Cr stabilized with 0.5% of niobium without any titanium (type EN 1.4595) for maximum temperatures below 900° C. These have high temperature resistance equivalent to those of the previous grades, but with better shaping capability.

Finally, for very high temperatures ranging up to 1,050° C. or for improved thermal fatigue resistances, an alternative of the grade EN 1.4521 AISI 444 is known with 19% Cr stabilized with 0.6% of niobium and containing 1.8% of molybdenum (see document EP-A-1 818 422).

However, in spite of their good hot mechanical properties and during oxidation in a standard exhaust gas atmosphere, the mentioned ferritic grades excessively corrode at grain boundaries, in the presence of a projection of a mixture of water, urea and ammonia and for temperatures comprised between 150 and 700° C. This makes these steels insufficiently adapted for their use in exhaust lines equipped with pollution control systems with urea or ammonia, as this is often the case, for example on diesel engine vehicles.

It was moreover noted that the intergranular corrosion phenomena by urea were worsened when an austenitic grade either stabilized or not was used (types EN 1.4301 AISI 304, EN 1.4541 AISI 321 or EN 1.4404 AISI 316L). Such grades are therefore not a fully satisfactory solution to the encountered problems.

The object of the present invention is to solve the corrosion problems mentioned above. In particular, it aims at making available to the users of engines equipped with a pollution control system for exhaust gases with urea or ammonia, a ferritic stainless steel which has, as compared with known grades for this purpose, improved resistance to corrosion by a mixture of water, urea and ammonia.

This steel should also retain good resistance under hot conditions, i.e. high creep, thermal fatigue and oxidation resistances at temperatures of use which vary periodically and which may attain several hundred ° C., as well as a capability of cold-shaping and of welding equivalent to that of the grade EN 1.4509 AISI 441, i.e. guaranteeing a minimum elongation at break of 28% in traction, for mechanical tensile characteristics of typically 300 MPa for the elastic limit Re and 490 MPa for the tensile strength Rm.

Finally, the mechanical resistance of the welds of the exhaust line made with this steel should be excellent.

For this purpose, the object of the invention is a ferritic stainless steel sheet with a composition, expressed in weight percentages:

- trace amounts≤C≤0.03%;
- 0.2%≤Mn≤1%;
- 0.2%≤Si≤1%;
- trace amounts≤S≤0.01%;
- trace amounts≤P≤0.04%;
- 15%≤Cr≤22%;
- trace amounts≤Ni≤0.5%;
- trace amounts≤Mo≤2%;
- trace amounts≤Cu≤0.5%;
- 0.160≤Ti≤1%;
- 0.02%≤Al≤1%;
- 0.2%≤Nb≤1%;
- trace amounts≤V≤0.2%;
- 0.009%≤N≤0.03%; preferably between 0.010 and 0.020%;
- trace amounts≤Co≤0.2%;
- trace amounts≤Sn≤0.05%;
- rare earths (REE)≤0.1%;
- trace amounts≤Zr≤0.01%;
- the remainder of the composition consisting of iron and inevitable impurities resulting from the elaboration;
- the Al and rare earth (REE) contents satisfy the relationship:

$$Al+30\times REE\geq 0.15\%;$$

- the Nb, C, N and Ti contents in % satisfy the relationship:

$$1/[Nb+(7/4)\times Ti-7\times(C+N)]\leq 3;$$

said sheet having an entirely recrystallized structure and an average ferritic gain size comprised between 25 and 65 μm.

The object of the invention is also two methods for manufacturing a ferritic stainless steel sheet of the previous type.

According to a first method:

a steel is elaborated having the composition mentioned previously;

it is proceeded with the casting of a semi-finished product from this steel;

the semi-finished product is brought to a temperature above 1,000° C. and less than 1,250° C., and the semi-finished product is hot-rolled in order to obtain a hot-rolled sheet with a thickness comprised between 2.5 and 6 mm;

said hot-rolled sheet is cold-rolled at a temperature of less than 300° C., in a single step or in several steps separated by intermediate annealings;

final annealing of the cold-rolled sheet is performed, at a temperature comprised between 1,000 and 1,100° C. and for a period comprised between 10 seconds and 3 minutes, in order to obtain a completely recrystallized structure with an average grain size comprised between 25 and 65 μm.

According to a second method:

a steel is elaborated having the composition mentioned earlier;

it is proceeded with casting a semi-finished product from this steel;

the semi-finished product is brought to a temperature above 1,000° C. and less than 1,250° C., preferably between 1,180 and 1,200° C., and the semi-finished product is hot-rolled in order to obtain a hot-rolled sheet with a thickness comprised between 2.5 and 6 mm;

the cold-rolled sheet is annealed at a temperature comprised between 1,000 and 1,100° C. and for a period comprised between 30 seconds and 6 minutes;

the hot-rolled sheet is cold-rolled, at a temperature of less than 300° C., in a single step or in several steps separated by intermediate annealings;

final annealing of the cold-rolled sheet is performed at a temperature comprised between 1,000 and 1,100° C. and for a period comprised between 10 seconds and 3 minutes, in order to obtain a completely recrystallized structure having an average grain size comprised between 25 and 65 micrometers.

Preferably, in both methods, the hot rolling temperature is comprised between 1,180 and 1,200° C.

Preferably, in both methods, the final annealing temperature is comprised between 1,050 and 1,090° C.

The object of the invention is also the use of such a steel sheet for manufacturing parts involving shaping and welding and intended to be subject to a periodical temperature of use comprised between 150° C. and 700° C. and to projection of a mixture of water, urea and ammonia or to a projection of urea or of ammonia.

These may notably be parts of exhaust lines of internal combustion engines equipped with a catalytic system for reducing nitrogen oxides by injecting urea or ammonia.

As will have been understood, the invention is based on the use of ferritic stainless steel sheets having the specified composition and structure, for which the inventors have discovered that they were particularly well adapted to resolution of the technical problems mentioned earlier.

The average grain size comprised between 25 and 65 μm is an important characteristic of the invention, and it is controlled both by the presence of titanium and niobium nitrides and carbonitrides and by the temperature for carrying out the final annealing.

A too small grain size hardens the metal, therefore limiting its shaping capability, accelerates diffusion of nitrogen from the decomposition of urea (since the grain boundary density is more significant than in the case of the invention), and reduces creep resistance.

Conversely, a too large grain size reduces the resilience of the metal notably at the welded areas (in particular heat-affected areas) and degrades the aspect of the parts after shaping (orange peel).

Obtaining the average grain size range according to the invention avoids these drawbacks.

The invention will now be described in detail, with reference to the following figures:

FIG. 1 which shows the thermal cycle to which the samples were subject during tests which will be described;

FIG. 2 which shows the sectional micrograph along its thickness of the first 0.150 mm of a sample of a reference steel after a corrosion test by urea;

FIG. 3 which shows the sectional micrograph along its thickness of the first 0.150 mm of a sample of a steel according to the invention after a corrosion test by urea carried out under the same conditions as for the steel of FIG. 2.

The presence of various chemical elements and their content ranges will first be justified. All the contents are given in weight percentages.

The carbon would be able to increase the mechanical characteristics at high temperature, in particular creep resistance. However, due to its very low solubility in ferrite, the carbon tends to precipitate as carbides $M_{23}C_6$ or $M_7C_3$ between about 600° C. and 900° C., for example chromium carbides. This predpitation, generally located at the grain boundaries may lead to depletion of chromium in the vicinity of these boundaries, and therefore to sensitization of the metal to intergranular corrosion. This sensitization may in particular be encountered in heat-affected areas (HAA), which were heated to a very high temperature during welding. The carbon content therefore has to be low, i.e. limited to 0.03% in order to obtain satisfactory resistance to intergranular corrosion as well as not to reduce formability. Further, the carbon content should satisfy a relationship with niobium, titanium and nitrogen, as will be explained later on.

Manganese improves the adherence of the oxide layer protecting the metal against corrosion, when its content is greater than 0.2%. However, beyond 1%, the hot oxidation kinetics become too rapid and a less compact oxide layer develops, formed with spinelle and with chromine. The manganese content should therefore be contained between both of these limits.

Like chromium, silicon is a very efficient element for increasing resistance to oxidation during thermal cycles. In order to ensure this role, a minimum content of 0.2% is required. However, in order not to reduce the hot rolling capability and the cold-shaping capability, the silicon content should be limited to 1%.

Sulfur and phosphorus are undesirable impurities in significant amounts, since they reduce the hot ductility and formability. Further, phosphorous easily segregates at the grain boundaries and reduces their cohesion. On this basis, the sulfur and phosphorous contents should be less than or equal to 0.01% and 0.04% respectively. These maximum contents are obtained by careful selection of the raw materials and/or by metallurgical treatments carried out on the liquid metal during elaboration.

Chromium is an essential element for stabilizing the ferritic phase and for increasing resistance to oxidation. In connection with the other elements present in the steel of the invention, its minimum content should be greater than or equal to 15% in order to obtain a ferritic structure at all the temperatures of use and to obtain good resistance to oxidation. However, its maximum content should not exceed 22%, otherwise it would excessively increase the mechanical strength at room temperature, which reduces the capability of being shaped, or promotes embrittlement by demixing of the ferrite around 475° C.

Nickel is a gammagenic element which increases ductility of steel. In order to retain a ferritic single-phase structure under all circumstances, its content should be less than or equal to 0.5%.

Molybdenum improves resistance to pitting corrosion, but it reduces ductility and shaping capability. This element is therefore not mandatory and the content is limited to 2%.

Copper has a hot hardening effect which may be favorable. Present in an excessive amount, it however reduces ductility during hot rolling and weldability. On this basis, the copper content should therefore be less than or equal to 0.5%.

Aluminium is an important element of the invention. Indeed, either together or not with rare earths (REE), it improves resistance to corrosion by urea if the formula $Al+30\times REE\geq 0.15\%$ is observed, and if stabilization of the metal is moreover achieved by titanium or niobium. Synergy between the elements Ti, Nb, Al and REE for limiting diffusion to the grain boundaries of the nitrogen for example from the decomposition of urea, is demonstrated by experiments which will be described later on.

Moreover aluminium, either associated or not with rare earths, strongly improves the mechanical strength of the MIG/MAG welds (better strength of the HAA). However, this improvement is only observed for chromium-forming ferritic stainless steels i.e. containing less than 1% of aluminium. On the other hand, an aluminium content of more than 1% strongly embrittles ferrite and greatly reduces its cold-shaping properties. The content thereof is therefore limited to 1%. A minimum aluminium content of 0.020 is indispensable to the invention (while the REEs are not mandatory) in order to allow control of germination and therefore of the TiN grain size.

Niobium and titanium are also important elements of the invention. Usually, these elements may be used as stabilizing elements in ferritic stainless steels. Indeed, the phenomenon of sensitization to intergranular corrosion by formation of chromium carbides, which was mentioned above, may be avoided by adding elements forming highly thermally stable carbonitrides.

In particular, titanium and nitrogen combine together even before the solidification of the liquid metal in order to form TiN; and in the solid state around 1,100° C., titanium carbides and carbonitrides are formed. In this way, carbon and nitrogen present in the solid solution in the metal during its use are reduced as much as possible. Such a presence at too high levels would reduce the corrosion resistance of the metal and would harden it. In order to obtain this effect in a sufficient way, a minimum Ti content of 0.16% is required. It should be noted that usually, precipitation of the TiN in the liquid metal is considered by steelmakers as a drawback in that it may lead to accumulation of these precipitates on the walls of the nozzles of the casting containers (ladle, continuous casting distributor) which risks blocking these nozzles. But the TiN improve the structure which develops during the solidification by contributing to obtaining an equi-axed structure rather than a dendritic structure, and therefore improving the homogeneity of the final grain size. In the case of the invention, it is considered that the advantages of this precipitation outweigh its drawbacks, which may be minimized by selecting casting conditions reducing the risks of blocking the nozzles.

Niobium combines with nitrogen and carbon in the solid state and stabilizes the metal, just like titanium. Niobium therefore binds carbon and nitrogen in a stable way. But niobium also combines with iron so as to form in the range of 550° C.-950° C. intermetallic compounds at the grain boundaries, i.e. Laves phases $Fe_2Nb$, which improves creep resistance in this temperature range. A minimum niobium content of 0.2% is required for obtaining this property. The conditions for obtaining this improvement in creep resistance are also strongly related to the manufacturing method of the invention, in particular the annealing temperatures and to a controlled average grain size and maintained within the limits from 25 to 65 μm.

Finally, experiment shows that when their titanium and niobium contents, associated with the carbon and nitrogen contents, observe the relationship $1/[Nb+(7/4)\times Ti-7\times(C+N)]\leq 3$, corrosion by urea between 150° C. and 700° C. is strongly reduced. This is explained by the guarantee of having an amount of Ti and Nb still free in the metal giving the possibility of contributing to limiting the diffusion of the nitrogen from the decomposition of the urea at the grain boundaries. This sole condition is, however, not sufficient, and addition of aluminium or rare earths under the further mentioned conditions is required.

However, additions of niobium and titanium should moreover be limited. When at least one of the niobium and titanium contents is greater than 1% by weight, the obtained hardening is too large, the steel is less easily deformable and recrystallization after cold rolling is more difficult.

Zirconium would have a stabilizing role close to that of titanium, but is not deliberately used in the invention. Its content is less than 0.01%, and therefore should remain of the order of a residual impurity. An addition of Zr would be expensive, and especially detrimental, since zirconium carbonitrides, because of their shape and large size, strongly reduce the resilience of the metal.

Vanadium is not a very efficient stabilizer within the context of the invention considering the low stability of vanadium carbonitrides at a high temperature. On the other hand, it improves ductility of the welds. However, at moderate temperatures in a nitrogen-containing atmosphere, it promotes nitridation of the surface of the metal by diffusion of nitrogen. The content thereof is limited to 0.2%, considering the targeted application.

Like carbon, nitrogen increases the mechanical characteristics. However, nitrogen tends to precipitate at the grain boundaries in the form of nitrides, thus reducing resistance to corrosion. In order to limit the problems of sensitization to intergranular corrosion, the nitrogen content should be less than or equal to 0.03%. Further the nitrogen content should observe the previous relationship connecting Ti, Nb, C and N. A nitrogen minimum of 0.009% is, however, necessary for the invention, since it guarantees the presence of TiN precipitates, and also good recrystallization of the cold-rolled strip during the final annealing operation allowing a grain with an average size of less than 65 microns to be obtained. A content between 0.010% and 0.020%, for example 0.013%, may be recommended.

Cobalt is a hot hardening element but which degrades formability. For this purpose, its content should be limited to 0.2% by weight.

In order to avoid hot forging problems, the tin content should be less than or equal to 0.05%.

Rare earths (REEs) group a set of elements like cerium and lanthanum, inter alia and are known for improving adherence of the oxide layers which make steel resistant to corrosion. It has also been shown that rare earths improve resistance to intergranular corrosion by urea between 150° C. and 700° C. as in the case of the aluminium already described, and by observing the relationship Al+30×REE≥0.15%. In synergy with aluminium and the stabilizers, the REE contribute to limiting diffusion of nitrogen. However, the rare earth content should not exceed 0.1%. Beyond this content, elaboration of the metal would be made difficult because of the reactions of the REEs with the refractories coating the ladle. These reactions would lead to notable formation of REE oxides which would degrade the steel inclusion cleanliness. Further, the efficiency of REEs is sufficient at the proposed contents, and going beyond would only unnecessarily increase the cost of the elaboration because of the high cost of REEs, and also of accelerated wear of the refractories which this would cause.

The sheet according to the invention may notably be obtained by the following method:

a steel is elaborated having the previous composition;

it is proceeded with casting a semi-finished product from this steel;

the semi-finished product is brought to a temperature above 1,000° C. and below 1,250° C., preferably between 1,180 and 1,200° C., and the semi-finished product is hot-rolled in order to obtain a hot-rolled sheet with a thickness comprised between 2.5 and 6 mm;

said hot-rolled sheet is cold-rolled at a temperature comprised between room temperature and 300° C., in a single step or in several steps separated by intermediate annealings; it should be understood that, by the term of "step", is meant here cold-rolling including either a single pass or a succession of several passes (for example five passes) which are not separated by any intermediate annealing; for example, a cold-rolling sequence may be contemplated, including a first series of five passes, and then an intermediate annealing, and then a second sequence of five passes; typically (these data, which are customary for conventional methods for manufacturing ferritic stainless steel sheets, are not limiting for the definition of the invention), the intermediate annealing separating the steps are performed between 950 and 1,100° C. for 30 s to 6 min;

final annealing of the cold-rolled sheet is performed at a temperature comprised between 1,000 and 1,100° C., preferably between 1,050° C. and 1,090° C., and for a period comprised between 10 seconds and 3 minutes in order to obtain a completely recrystallized structure with an average grain size comprised between 25 and 65 μm.

Alternatively, it is possible to add an annealing step between the hot rolling and the cold rolling. This annealing takes place between 1,000 and 1,100° C. for a period from 30 s to 6 min.

A series of experiments demonstrating the advantage of the invention will now be described. Laboratory castings were studied, the chemical analyses of which are given in Table 1.

TABLE 1

Analyses of laboratory castings

| | Casting | % C | % Si | % Mn | % Cr | % Ni | % Mo | % Ti | % Nb | % Cu | % Co | % N | % P | % S | % Al | % Sn |
|---|---|---|---|---|---|---|---|---|---|---|---|---|---|---|---|---|
| Analysis according to the invention | 1 | 0.016 | 0.56 | 0.33 | 17.71 | 0.290 | 0.010 | 0.170 | 0.370 | 0.07 | 0.03 | 0.012 | 0.025 | 0.001 | 0.255 | 0.010 |
| | 2 | 0.016 | 0.57 | 0.34 | 17.63 | 0.290 | 0.026 | 0.170 | 0.400 | 0.08 | 0.03 | 0.012 | 0.025 | 0.001 | 0.190 | 0.011 |
| | 3 | 0.018 | 0.57 | 0.34 | 17.67 | 0.290 | 0.028 | 0.170 | 0.400 | 0.08 | 0.03 | 0.012 | 0.026 | 0.001 | 0.300 | 0.006 |
| | 4 | 0.016 | 0.32 | 0.49 | 17.87 | 0.023 | 0.001 | 0.170 | 0.600 | 0.01 | 0.02 | 0.017 | 0.017 | 0.001 | 0.030 | 0.007 |
| | 5 | 0.013 | 0.33 | 0.50 | 17.70 | 0.020 | 0.002 | 0.180 | 0.610 | 0.01 | 0.01 | 0.020 | 0.017 | 0.002 | 0.041 | 0.012 |
| | 6 | 0.015 | 0.62 | 0.30 | 17.77 | 0.015 | 0.040 | 0.180 | 0.380 | 0.02 | 0.02 | 0.019 | 0.018 | 0.001 | 0.045 | 0.022 |
| | 7 | 0.015 | 0.33 | 0.51 | 17.79 | 0.250 | 0.065 | 0.180 | 0.630 | 0.01 | 0.02 | 0.015 | 0.017 | 0.003 | 0.160 | 0.031 |
| | 8 | 0.022 | 0.40 | 0.41 | 17.50 | 0.120 | 1.800 | 0.300 | 0.510 | 0.23 | 0.15 | 0.011 | 0.020 | 0.005 | 0.030 | 0.030 |
| | 9 | 0.019 | 0.55 | 0.34 | 16.20 | 0.130 | 0.021 | 0.200 | 0.420 | 0.06 | 0.16 | 0.014 | 0.027 | 0.001 | 0.150 | 0.004 |
| | 10 | 0.020 | 0.45 | 0.38 | 21.15 | 0.350 | 0.220 | 0.600 | 0.250 | 0.20 | 0.05 | 0.018 | 0.022 | 0.002 | 0.220 | 0.030 |
| | 11 | 0.027 | 0.24 | 0.33 | 15.41 | 0.230 | 0.320 | 0.210 | 0.260 | 0.01 | 0.11 | 0.012 | 0.014 | 0.005 | 0.330 | 0.001 |
| Reference analysis | 12 | 0.013 | 0.53 | 0.21 | 17.84 | 0.118 | 0.005 | 0.152 | 0.462 | 0.06 | 0.02 | 0.023 | 0.025 | 0.002 | 0.004 | 0.006 |
| | 13 | 0.012 | 0.56 | 0.20 | 17.60 | 0.110 | 0.003 | 0.160 | 0.398 | 0.01 | 0.01 | 0.004 | 0.022 | 0.002 | 0.004 | 0.005 |
| | 14 | 0.019 | 0.33 | 0.50 | 17.92 | 0.002 | 0.001 | 0.160 | 0.650 | 0.01 | 0.18 | 0.018 | 0.017 | 0.003 | 0.010 | 0.012 |
| | 15 | 0.016 | 0.32 | 0.49 | 17.80 | 0.004 | 0.003 | 0.510 | 0.440 | 0.02 | 0.12 | 0.014 | 0.017 | 0.002 | 0.012 | 0.021 |
| | 16 | 0.017 | 0.62 | 0.29 | 17.58 | 0.120 | 0.010 | 0.160 | 0.390 | 0.05 | 0.02 | 0.017 | 0.027 | 0.002 | 0.010 | 0.020 |
| | 17 | 0.025 | 0.65 | 0.40 | 19.00 | 0.120 | 1.900 | 0.012 | 0.600 | 0.05 | 0.03 | 0.022 | 0.022 | 0.001 | 0.010 | 0.032 |
| | 18 | 0.017 | 0.52 | 0.31 | 16.97 | 0.160 | 0.800 | 0.330 | 0.026 | 0.06 | 0.02 | 0.018 | 0.022 | 0.001 | 0.009 | 0.006 |
| | 19 | 0.012 | 0.58 | 0.25 | 14.82 | 0.120 | 0.004 | 0.007 | 0.430 | 0.02 | 0.02 | 0.019 | 0.018 | 0.002 | 0.011 | 0.004 |
| | 20 | 0.016 | 0.51 | 0.30 | 17.20 | 0.002 | 0.840 | 0.340 | 0.001 | 0.02 | 0.01 | 0.013 | 0.018 | 0.002 | 0.047 | 0.033 |
| | 21 | 0.012 | 0.65 | 0.37 | 17.21 | 0.098 | 0.022 | 0.240 | 0.015 | 0.10 | 0.02 | 0.008 | 0.019 | 0.001 | 1.700 | 0.003 |
| | 22 | 0.015 | 0.25 | 0.41 | 17.00 | 0.200 | 0.030 | 0.110 | 0.180 | 0.03 | 0.01 | 0.020 | 0.012 | 0.007 | 0.013 | 0.021 |
| | 23 | 0.016 | 0.65 | 0.33 | 15.91 | 0.170 | 0.029 | 0.390 | 0.016 | 0.07 | 0.02 | 0.015 | 0.022 | 0.001 | 0.023 | 0.002 |
| | 24 | 0.017 | 0.52 | 0.35 | 17.17 | 0.180 | 0.020 | 0.430 | 0.010 | 0.06 | 0.02 | 0.014 | 0.020 | 0.001 | 0.022 | 0.010 |
| | 25 | 0.018 | 0.23 | 0.26 | 17.28 | 0.117 | 1.219 | 0.004 | 0.398 | 0.06 | 0.01 | 0.018 | 0.022 | 0.002 | 0.002 | 0.004 |
| | 26 | 0.020 | 0.38 | 0.40 | 17.51 | 0.160 | 2.010 | 0.180 | 0.280 | 0.06 | 0.02 | 0.020 | 0.019 | 0.001 | 0.008 | 0.021 |
| | 27 | 0.028 | 0.62 | 0.52 | 20.00 | 0.250 | 0.150 | 0.220 | 0.025 | 0.02 | 0.15 | 0.019 | 0.013 | 0.008 | 0.011 | 0.032 |
| | 28 | 0.008 | 0.48 | 0.22 | 11.51 | 0.074 | 0.003 | 0.150 | 0.003 | 0.04 | 0.02 | 0.012 | 0.020 | 0.004 | 0.014 | 0.003 |
| | 29 | 0.020 | 0.35 | 0.34 | 18.02 | 0.320 | 0.250 | 0.700 | 0.023 | 0.25 | 0.15 | 0.020 | 0.020 | 0.002 | 0.008 | 0.030 |

TABLE 1-continued

| | Analyses of laboratory castings | | | | | |
|---|---|---|---|---|---|---|
| | Casting | % V | ppm La | ppm Ce | ppm Pr | ppm Nd |
| Analysis according to the invention | 1 | 0.11 | 5 | 0.5 | 0.1 | 0.1 |
| | 2 | 0.12 | 5 | 0.5 | 0.1 | 0.1 |
| | 3 | 0.12 | 5 | 0.5 | 0.1 | 0.1 |
| | 4 | 0.14 | 580 | 0.5 | 0.1 | 0.1 |
| | 5 | 0.10 | 53 | 140 | 13 | 27 |
| | 6 | 0.10 | 62 | 240 | 21 | 44 |
| | 7 | 0.11 | 5 | 0.5 | 0.1 | 0.1 |
| | 8 | 0.15 | 70 | 300 | 1 | 2.2 |
| | 9 | 0.14 | 5 | 0.5 | 0.1 | 0.1 |
| | 10 | 0.10 | 5 | 0.6 | 0.1 | 3 |
| | 11 | 0.02 | 2 | 0.1 | 0.2 | 0.1 |
| Reference analysis | 12 | 0.10 | 5 | 0.5 | 0.1 | 0.1 |
| | 13 | 0.13 | 5 | 0.5 | 0.1 | 0.1 |
| | 14 | 0.12 | 5 | 0.5 | 0.1 | 0.1 |
| | 15 | 0.12 | 5 | 0.5 | 0.1 | 0.1 |
| | 16 | 0.12 | 5 | 0.5 | 0.1 | 0.1 |
| | 17 | 0.12 | 5 | 0.5 | 0.1 | 0.1 |
| | 18 | 0.13 | 5 | 0.5 | 0.1 | 0.1 |
| | 19 | 0.08 | 5 | 0.5 | 0.1 | 0.1 |
| | 20 | 0.14 | 57 | 270 | 23 | 49 |
| | 21 | 0.10 | 5 | 0.5 | 0.1 | 0.1 |
| | 22 | 0.09 | 400 | 0.1 | 0.1 | 0.1 |
| | 23 | 0.11 | 5 | 0.5 | 0.1 | 0.1 |
| | 24 | 0.10 | 5 | 0.5 | 0.1 | 0.1 |
| | 25 | 0.10 | 5 | 0.5 | 0.1 | 0.1 |
| | 26 | 0.12 | 5 | 0.5 | 0.1 | 0.1 |
| | 27 | 0.15 | 400 | 0.5 | 0.1 | 0.1 |
| | 28 | 0.08 | 5 | 0.5 | 0.1 | 0.1 |
| | 29 | 0.010 | 5 | 0.4 | 0.8 | 0.5 |

The cast samples were transformed according to the following method.

By hot rolling, the metal, which is initially in the form of a blank with a thickness of 20 mm, is brought to a temperature of 1,200° C., and is hot rolled in 6 passes down to a thickness of 2.5 mm.

According to an alternative of the method according to the invention, a first annealing of the hot rolled strip may then be carried out at 1,050° C. with maintaining for 1 min 30 s of the sample at this temperature. The examples according to the invention nos. 1 to 11 and a few reference examples (nos. 12 and 19) were treated with and without this first annealing, and it was possible to check that in both cases they have very similar final properties. By carrying out this first annealing, it is possible to obtain a slight improvement in formability, but for attaining typical goals of the invention, the conditions of the final annealing are the ones which are alone determining, in combination with the other essential features of the method and of course, the composition of the steel. The results shown in tables 2 and 3 correspond to those observed on samples having not been subject to the first annealing of the alternative which has just been described.

After shot peening and pickling, the metal is cold rolled at room temperature, i.e. about 20° C. in five passes, down to a thickness of 1 mm.

The metal is annealed at 1,050° C. with maintaining it at this temperature for 1 min 30 s and then it is stripped.

Metal coupons from each casting are subject to the test procedure A and are then analysed according to the analysis procedure B which will be described.

The phenomenon of corrosion by urea is revealed by the following test procedure A.

The sample is sprayed with a mixture containing 32.5% of urea and 67.5% of water (flow rate: 0.17 ml/min) and simultaneously undergoes a thermal cycle between 200 and 600° C., with a triangular signal of period 120 s as illustrated in FIG. 1 by curve 1. The rise in temperature from 200 to 600° C. lasts for 40 s, and then cooling begins as soon as the temperature of 600° C. is reached and continues down to 200° C. for 80 s.

According to the analysis procedure B, after 300 h of testing, a cut of the sample is made with a micro-saw. Electrolytic copper-plating of the sample is carried out, before coating, in a solution of $CuSO_4$ at 210 g/l and $H_2SO_4$ at 30 ml/l; the imposed current density is 0.07 A/cm$^2$ for 5 minutes, and then 0.14 A/cm$^2$ for 1 minute. This procedure is considered as optimum in order to obtain a good copper plating. Electrolytic etching is achieved in a solution of 5% oxalic acid for 15 s at 20° C. The imposed current density is 60 mA/cm$^2$.

This procedure B gives the possibility of revealing two areas corroded by urea, as observed in the microscope with a magnification of ×1000.

Two thereby treated examples are shown:

Figure 1:
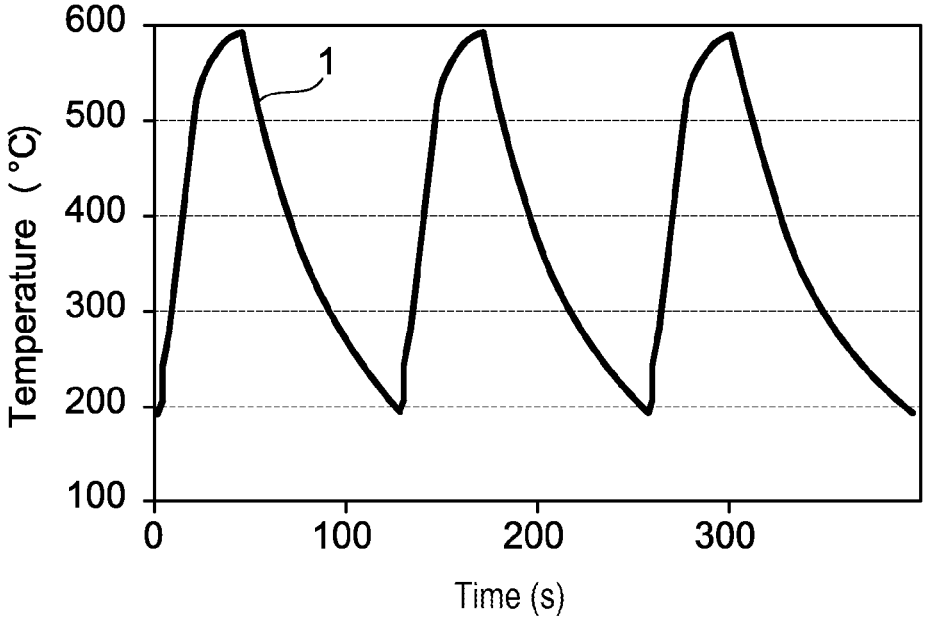
Figure 2:
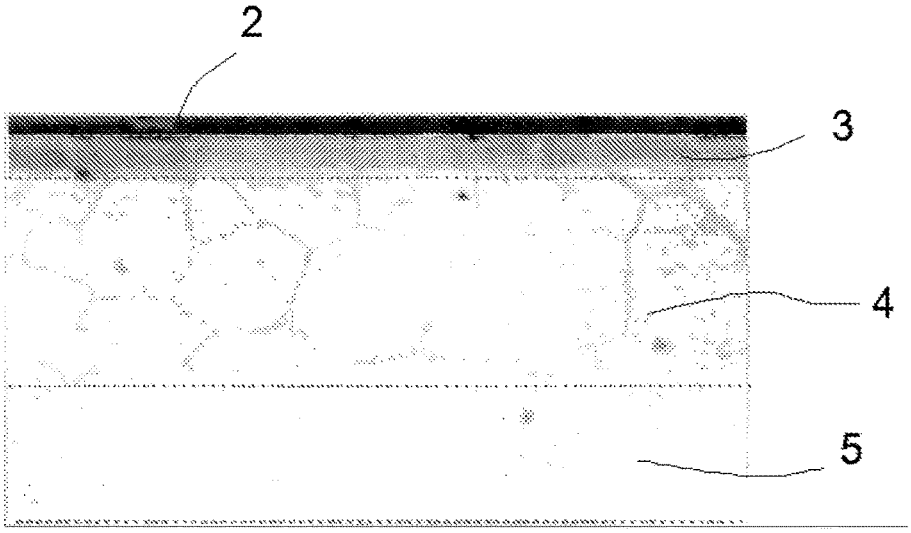
FIG. 2 shows the first 0.150 mm along the thickness of the sample corresponding to the reference sample No. 28 of Table 1.
Figure 3:
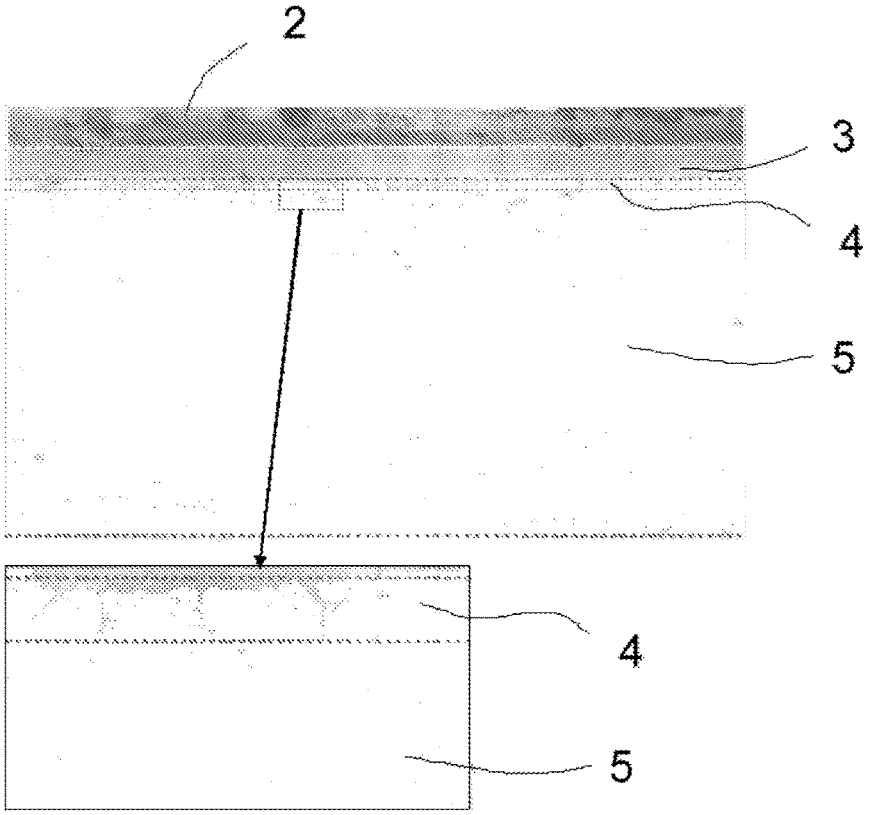
FIG. 3 shows the first 0.150 mm along the thickness of the sample corresponding to the sample according to the invention No. 2 of Table 1, one portion of which is further enlarged.

These samples are characterised, as this is seen in FIGS. 2 and 3:

by the presence at their surface of a copper deposit 2, which of course would be absent from an industrial product;

by a homogenous area 3 intended to be in contact with the atmosphere and which consists of a mixture of oxides and nitrides with a maximum thickness of 30 μm obtained after the procedures A and B.

by an intergranular corrosion area 4 located under the previous layer 3 in the metal, and containing precipitates of chromium nitrides; the thickness of the intergranular corrosion area is measured over the whole length of the cut (3 cm); the average of the 15 maximum values is made and gives the value retained as being the thickness of the intergranular corrosion area of the sample; the latter may attain 90 μm when the method according to the invention is not used, and is reduced to a few μm in the case of the invention, as this will be seen; the goal of the invention is to reach a thickness of the intergranular corrosion area of less than 7 μm under the mentioned test conditions, so as to be sure not to be subject to any redhibitory damage of the surface of the metal due to fatigue or to acid corrosion by the condensates, during its use in an exhaust line.

Underneath this intergranular corrosion area, the metal 5 is not affected.

The mechanical resistance of the welds was evaluated by means of a tensile test at 300° C. Two samples from a same cast are welded with the MIG/MAG method with a 430LNb wire under the following conditions: 98.5% of argon, 1.5% of oxygen, voltage: 26 V, wire velocity: 10 m/min, intensity: 250 A, welding rate: 160 cm/min, energy: 2.5 kJ/cm (welding procedure C). The result is estimated all the more satisfactory since the ratio between the mechanical strength for the welded specimen and for the non-welded specimen is close to 100%.

The results of the tests conducted on various samples are shown in table 2, which also specifies whether the tested samples observe three of the particular analytic conditions required by the invention (in which case the values are underlined).

This table shows that under equal treatment conditions, simultaneous observance of three analytic conditions on the proposed analysis is required for guaranteeing intergranular etching over a thickness of less than 7 μm:

$$1/[Nb+7/4Ti-7*(C+N)]\leq 3;$$

$$Al+30REE\geq 0.15\%;$$

$$Nb\geq 0.2\%.$$

It also shows that the welds carried out on the castings according to the invention have mechanical resistances highly comparable with those of the base metal, i.e. always greater than 80%. The mechanical strength of the welds present in the components of the exhaust line, in particular when they are obtained with the MIG/MAG method, is therefore improved by the invention.

Moreover, a minimum Nb content of 0.2% is a condition for improving creep resistance and limiting the deformation of the parts upon their use at a high temperature.

For all the samples according to the invention, the mechanical tensile characteristics found are equivalent to that of 1.4509. In particular, it was checked that the elongation at break A is actually always greater than 28%.

Additional experiments notably conducted on samples of casting No. 2 which observes the composition conditions according to the invention gave the possibility of demonstrating that obtaining the entirely recrystallized structure and the grain size as prescribed is further indispensable for satisfying the requirements of the invention. Their results are grouped in Table 3.

TABLE 2

Results of the intergranular corrosion test by urea and of the mechanical resistance of the welds at 300° C.

| | Casting | Size of the grains (μm) | 0.15 ≤ AI + 30REE | 0.2 ≤ Nb | 1/[Nb + 7/4 Ti − 7*(C + N)] ≤ 3 | Intergranular corrosion by urea-thickness (μm) | Mechanical resistance of the welds at 300° C. (% based on the base metal) |
|---|---|---|---|---|---|---|---|
| analyses according to the invention | 1 | 27 | 0.272 | 0.370 | 2.10 | 2 | 90 |
| | 2 | 35 | 0.207 | 0.400 | 2.00 | 3 | 90 |
| | 3 | 49 | 0.317 | 0.400 | 2.04 | 2 | 85 |
| | 4 | 31 | 1.772 | 0.600 | 1.50 | 2 | 85 |
| | 5 | 28 | 0.740 | 0.610 | 1.44 | 2 | 95 |
| | 6 | 62 | 1.146 | 0.380 | 2.18 | 4 | 90 |
| | 7 | 45 | 0.177 | 0.630 | 1.36 | 2 | 95 |
| | 8 | 55 | 1.150 | 0.510 | 1.24 | 3 | 95 |
| | 9 | 48 | 0.167 | 0.420 | 1.86 | 5 | 90 |
| | 10 | 29 | 0.246 | 0.250 | 0.97 | 3 | 95 |
| | 11 | 32 | 0.337 | 0.260 | 2.82 | 3 | 85 |
| Reference analyses | 12 | 57 | 0.021 | 0.462 | 2.08 | 9 | 65 |
| | 13 | 28 | 0.021 | 0.398 | 1.77 | 9 | 50 |
| | 14 | 31 | 0.027 | 0.650 | 1.49 | 9 | 65 |
| | 15 | 44 | 0.029 | 0.440 | 0.89 | 9 | 55 |
| | 16 | 62 | 0.027 | 0.390 | 2.28 | 11 | 60 |
| | 17 | 33 | 0.027 | 0.600 | 3.42 | 21 | 65 |
| | 18 | 45 | 0.026 | 0.026 | 2.76 | 8 | 60 |
| | 19 | 41 | 0.028 | 0.430 | 4.39 | 30 | 65 |
| | 20 | 28 | 1.244 | 0.001 | 2.55 | 15 | 60 |
| | 21 | 46 | 1.717 | 0.015 | 3.39 | 16 | 60 |
| | 22 | 55 | 1.214 | 0.180 | 7.84 | 40 | 55 |
| | 23 | 36 | 0.040 | 0.016 | 2.08 | 13 | 55 |
| | 24 | 26 | 0.039 | 0.010 | 1.82 | 8 | 50 |
| | 25 | 42 | 0.019 | 0.398 | 6.38 | 40 | 60 |
| | 26 | 61 | 0.025 | 0.280 | 3.17 | 10 | 55 |
| | 27 | 33 | 1.213 | 0.025 | 12.35 | 42 | 60 |
| | 28 | 56 | 0.031 | 0.003 | 7.97 | 80 | 65 |
| | 29 | 44 | 0.028 | 0.023 | 1.03 | 35 | 60 |

TABLE 3

Depth of the intergranular corrosion by urea and mechanical resistance of the welds according to the average grain size of a sample.

| Average grain size (μm) | Final annealing temperature (° C.) | AI + 30*REE (%) | Nb (%) | 1/[Nb + 7/4Ti − 7*(C + N)] | Intergranular corrosion by urea, depth (μm) | Mechanical resistance of the welds at 300° C. (% based on that of the base metal) |
|---|---|---|---|---|---|---|
| 35 | 1070 | 0.207 | 0.4 | 2 | 3 | 90 |
| 5 | 900 | 0.207 | 0.4 | 2 | 11 | 90 |
| 200 | 1150 | 0.207 | 0.4 | 2 | 2 | 70 |

It is therefore seen, according to table 3 that the grain size obtained on the product after final annealing is a fundamental characteristic for simultaneously obtaining all the targeted properties. A too small grain size (5 μm in the mentioned example) leads to intergranular corrosion by urea which extends over a too large depth. A too large grain size (200 μm in the mentioned example) gives the possibility of retaining sufficiently low sensitivity to intergranular corrosion, but it is then the mechanical resistance of the welds which becomes unsatisfactory.

It should also be specified that during the application of the method according to the invention, it is conceivable, without departing from the scope of the invention, of practicing one or several picklings of the metal sheet, following heat and thermomechanical treatments carried out at a more or less high temperature (hot rolling, annealings) if the latter have been carried out in an oxidizing atmosphere such as air, and have therefore led to the formation of an undesirable layer of slag at the surface of the metal sheet. It was seen that such picklings have been practiced during the elaboration of the examples above. This formation of a slag may be limited or avoided when the heat or thermomechanical treatment is carried out in a neutral or reducing atmosphere, as this is well known. The properties for which the metal sheet according to the invention is particularly advantageous are not affected by either performing such picklings or not.

What is claimed is:

1. A ferritic stainless steel sheet comprising a composition, expressed in weight percentages:

trace amounts≤C≤0.03%;
0. 2%≤Mn≤1%;
0. 2%≤Si≤1%;
trace amounts≤S≤0.01%;
trace amounts≤P≤0.04%;
15%≤Cr≤22%;
trace amounts≤Ni≤0.5%;
trace amounts≤Mo≤2%;
trace amounts≤Cu≤0.5%;
0.160%≤Ti≤1%;
0.02%≤Al≤1%;
0.2%≤Nb≤1%;
trace amounts≤V≤0.2%;
0.009%≤N≤0.03%;
trace amounts≤Co≤0.2%;
trace amounts≤Sn≤0.05%;
rare earths (REE)≤0.1%;
trace amounts≤Zr≤0.01%;
the remainder of the composition consists of iron and inevitable impurities resulting from the elaboration,
wherein the Al and rare earth (REE) contents satisfy the relationship:

$$Al+30\times REE\geq 0.15\%;$$

the Nb, C, N and Ti contents in % satisfy the relationship:

$$1/[Nb+(7/4)\times Ti-7\times(C+N)]\leq 3, \text{ and}$$

said metal sheet comprises an entirely recrystallized structure and an average ferritic grain size is between 25 and 65 μm.

2. A method for manufacturing a ferritic stainless steel sheet comprising a composition, expressed in weight percentages:

trace amounts≤C≤0.03%;
0.2%≤Mn≤1%;
0.2%≤Si≤1%;
trace amounts≤S≤0.01%;
trace amounts≤P≤0.04%;
15%≤Cr≤22%;
trace amounts≤Ni≤0.5%;
trace amounts≤Mo≤2%;
trace amounts≤Cu≤0.5%;
0.160%≤Ti≤1%;
0.02%≤Al≤1%;
0.2%≤Nb≤1%;
trace amounts≤V≤0.2%;
0.009%≤N≤0.03%;
trace amounts≤Co≤0.2%;
trace amounts≤Sn≤0.05%;
rare earths (REE)≤0.1%;
trace amounts≤Zr≤0.01%;
the remainder of the composition consists of iron and inevitable impurities resulting from the elaboration,
wherein the Al and rare earth (REE) contents satisfy the relationship:

$$Al+30\times REE\geq 0.15\%;$$

the Nb, C, N and Ti contents in % satisfy the relationship:

$$1/[Nb+(7/4)\times Ti-7\times(C+N)]\leq 3, \text{ the method comprising:}$$

casting a semi-finished product of the ferritic stainless steel sheet;
bringing the semi-finished product to a temperature above 1,000° C. and below 1,250° C.;
hot-rolling the semi-finished product in order to obtain a hot-rolled sheet with a thickness between 2.5 and 6 mm;
cold-rolling said hot-rolled sheet at a temperature between room temperature and 300° C., in a single step or in several steps separated by intermediate annealings;
final annealing the cold-rolled sheet performed at a temperature between 1,000 and 1,100° C. and for a period between 10 seconds and 3 minutes, in order to obtain a completely recrystallized structure with an average grain size between 25 and 65 μm.

3. A method for manufacturing a ferritic stainless steel sheet comprising a composition, expressed in weight percentages:

trace amounts≤C≤0.03%;
0.2%≤Mn≤1%;
0.2%≤Si≤1%;
trace amounts≤S≤0.01%;
trace amounts≤P≤0.04%;
15%≤Cr≤22%;
trace amounts≤Ni≤0.5%;
trace amounts≤Mo≤2%;
trace amounts≤Cu≤0.5%;
0.160%≤Ti≤1%;
0.02%≤Al≤1%;
0.2%≤Nb≤1%;
trace amounts≤V≤0.2%;
0.009%≤N≤0.03%;
trace amounts≤Co≤0.2%;
trace amounts≤Sn≤0.05%;
rare earths (REE)≤0.1%;
trace amounts≤Zr≤0.01%;

the remainder of the composition consists of iron and inevitable impurities resulting from the elaboration, wherein the Al and rare earth (REE) contents satisfy the relationship:

$$Al+30\times REE\geq 0.15\%;$$

the Nb, C, N and Ti contents in % satisfy the relationship:

$1/[Nb+(7/4)\times Ti-7\times(C+N)]\leq 3$, the method comprising:

casting a semi-finished product of the ferritic stainless steel sheet;

bringing the semi-finished product to a temperature above 1,000° C. and below 1,250° C.;

hot-rolling the semi-finished product in order to obtain a hot-rolled metal sheet with a thickness comprised between 2.5 and 6 mm;

annealing the hot-rolled metal sheet at a temperature between 1,000 and 1,100° C. and for a period comprised between 30 seconds and 6 minutes;

cold-rolling said hot-rolled metal sheet at a temperature of less than 300 ° C., in a single step or in several steps separated by intermediate annealings;

final annealing the cold-rolled metal sheet performed at a temperature between 1,000 and 1,100° C. and for a period between 10 seconds and 3 minutes, in order to obtain a completely recrystallized structure having an average grain size between 25 and 65 micrometers.

4. The method according to claim 2, wherein the hot-rolling temperature is from 1,180 to 1,200° C.

5. The method according to one of claims 2, wherein the final annealing temperature is comprised between 1,050 and 1,090° C.

6. Parts involving shaping and welding and intended to be subject to a periodic use temperature between 150° C. and 700° C. and to projection of a mixture of water, urea and ammonia or to a projection of urea or of ammonia comprising the ferritic stainless steel sheet according to claim 1.

7. The parts according to claim 6, wherein said parts are parts of exhaust lines of internal combustion engines equipped with a catalytic system for reducing nitrogen oxides by injection of urea or ammonia.

8. The ferritic stainless steel sheet according to claim 1, wherein the ferritic stainless steel sheet comprises 0.010%≤N≤0.020%.

9. The method for manufacturing a ferritic stainless steel sheet according to claim 2, wherein the ferritic stainless steel sheet comprises 0.010%≤N≤0.020%.

10. The method for manufacturing a ferritic stainless steel sheet according to claim 3, wherein the ferritic stainless steel sheet comprises 0.010%≤N≤0.020%.

* * * * *